US007211724B2

(12) United States Patent
Kobayashi et al.

(10) Patent No.: US 7,211,724 B2
(45) Date of Patent: May 1, 2007

(54) NOISE FILTER HAVING CASE AND CORE ASSEMBLED THEREIN

(75) Inventors: Katsumi Kobayashi, Nikaho (JP); Toshihiro Kuroshima, Sakata (JP); Hiroshi Suzuki, Nikaho (JP); Masaru Yaguchi, Sakata (JP); Setu Tsuchida, Sakata (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/303,965

(22) Filed: Dec. 19, 2005

(65) Prior Publication Data

US 2006/0172593 A1 Aug. 3, 2006

(30) Foreign Application Priority Data

Feb. 2, 2005 (JP) ..... 2005-026280

(51) Int. Cl.
*H01B 7/34* (2006.01)
*H01R 4/00* (2006.01)

(52) U.S. Cl. ..... 174/36; 174/92; 333/12

(58) Field of Classification Search ..... 174/36, 174/84 R, 92; 336/92, 175, 176; 333/12, 333/81 R See application file for complete search history.

(56) References Cited

U.S. PATENT DOCUMENTS 4,970,476 A * 11/1990 Kitagawa ..... 333/12
5,162,772 A * 11/1992 May ..... 336/92
5,291,172 A * 3/1994 Ito et al. ..... 336/65
5,334,955 A * 8/1994 Strnad ..... 333/12
5,355,109 A * 10/1994 Yamazaki ..... 336/92
5,764,125 A * 6/1998 May ..... 336/92
5,900,796 A * 5/1999 Parker ..... 336/92
5,942,964 A * 8/1999 Takeuchi ..... 336/92
5,994,979 A * 11/1999 Taketomi et al. ..... 333/181
2002/0125034 A1 * 9/2002 Kuo ..... 174/92

FOREIGN PATENT DOCUMENTS

JP A 3-181106 8/1991
JP U 3-77421 8/1991
JP A 10-41671 2/1998
JP A 2000-91136 3/2000
JP A 2004-193316 7/2004

* cited by examiner

*Primary Examiner*—William H. Mayo, III
(74) *Attorney, Agent, or Firm*—Oliff & Berridge, PLC

(57) ABSTRACT

A noise filter providing a simplified construction and capable of being used regardless of a diameter of a cable or a numbers of cables. The noise filter includes a core-holding section for holding a core, first and second cable-guiding sections, and two coupling sections coupling the first and second cable-guiding sections to ends of the core-holding section. The first and second cable-guiding section have truncated conical shape, and each divided into the four parts by a first to fourth slits arrayed in cruciform shape whose crossing position is coincident with an imaginary apex of the cable-guiding section. The coupling section has first to fourth circumferential elongated slots in communication with the proximal ends of the first to fourth slits.

13 Claims, 4 Drawing Sheets

NOISE FILTER HAVING CASE AND CORE ASSEMBLED THEREIN

BACKGROUND OF THE INVENTION

The present invention relates to a noise filter including a case and a tubular core assembled therein.

Hitherto, in noise filters, a magnetic core is disposed over an outer circumferential surface of an electric cable, thus absorbing noise current flowing through the electric cable. The core is brittle because it was made by baking or sintering. A case composed of two complementary halves is used for protecting the core and for mounting the core at a desired position of the electric cable.

In a conventional noise filter, a cable retaining segment is provided in the case. The cable retaining segment nips the electric cable. In this case, however, the case is inevitably complicated in shape. Consequently, a metal mold for molding the case is complex in shape. This lowers the productivity of the noise filter.

Laid-open Japanese Patent Application Publication No. 2004-193316 discloses a noise filter, in which a cable retaining segment is provided for respective halves of the case. The cable retaining segments nip the electric cable in the direction that is substantially perpendicular to parting faces of the complementary halves. Then, the electric cable contacts the cable retaining segments only at two points. In this case, an excessive pressure will be applied to the cable at one point if nipping force is to be increased. This may degrade durability of the electric cable.

To hold the electric cable by solely cable retaining segments in the opposite directions, sufficient rigidity is required in the cable retaining segments. In the latter case, however, such cable retaining segments do not provide sufficient nipping for an electric cable having relatively large diameter. Hence, the case with the rigid cable retaining segments is not available for holding various kinds of electric cables having various outer diameters.

A noise filter may be attached to an electric cable that is would once or a few times in a loop fashion, forming a bundle. If two cable retaining segments are used to hold the bundle of electric cable from the opposite directions, the electric cable, thus bundled, can hardly be held appropriately in its entirety.

SUMMARY OF THE INVENTION

It is therefore, an object of the present invention to provide a noise filter provided with a case having a simplified construction and capable of holding the cable irrespective of cable diameter and number of cables of the bundle in case of looped setting.

This and other objects of the present invention will be attained by a noise filter including a case and a core. The case includes a tubular core holding section, a tubular coupling section, and a tubular cable guiding section. The core is accommodatable in the case and provides a hollow space through which the cable extends. The tubular coupling section is disposed at at least one end of the core holding section. The tubular cable guiding section is connected to the coupling section and provides an opening through which the cable extends. The cable guiding section is tetrameric by slits including a first slit part, a second slit part, a third slit part and a fourth slit part. At least the cable guide section is made from a resilient material.

DETAILED DESCRIPTION OF THE PREFERRED EMBODIMENTS

Figure 1:
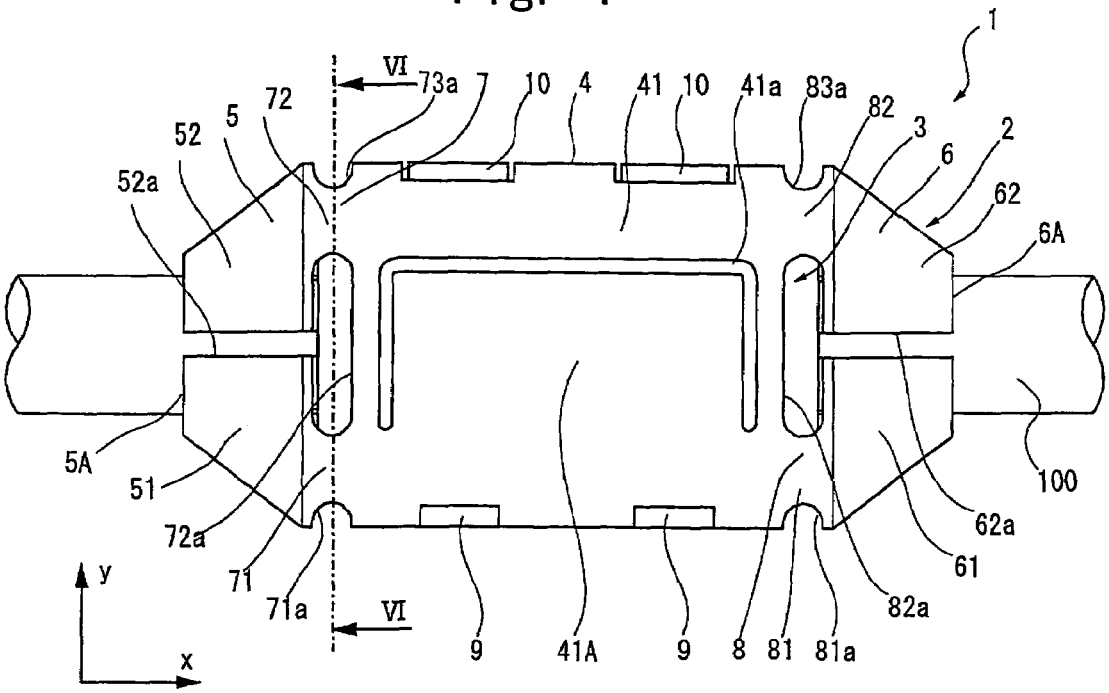
FIG. 1 is a plan view of a noise filter according an embodiment of the present invention.

A noise filter according to an embodiment of the present invention will be described with reference to FIGS. 1 through 7. FIG. 1 shows a noise filter 1 secured to a cable 100. As shown in FIG. 1, the noise filter 1 includes a case 2 and a core 3. The case 2 generally has a hollow cylindrical configuration and is made from resin provided with a resiliency. The core 3 is shaped like a hollow cylinder made from a magnetic substance and has a through hole allowing the cable 100 to pass therethrough.

Figure 2:
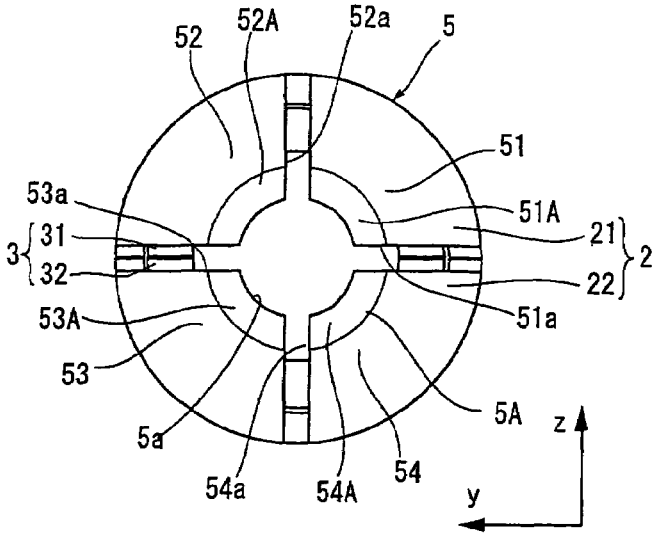
FIG. 2 is a side view of the noise filter according the embodiment of the invention.
Figure 5:
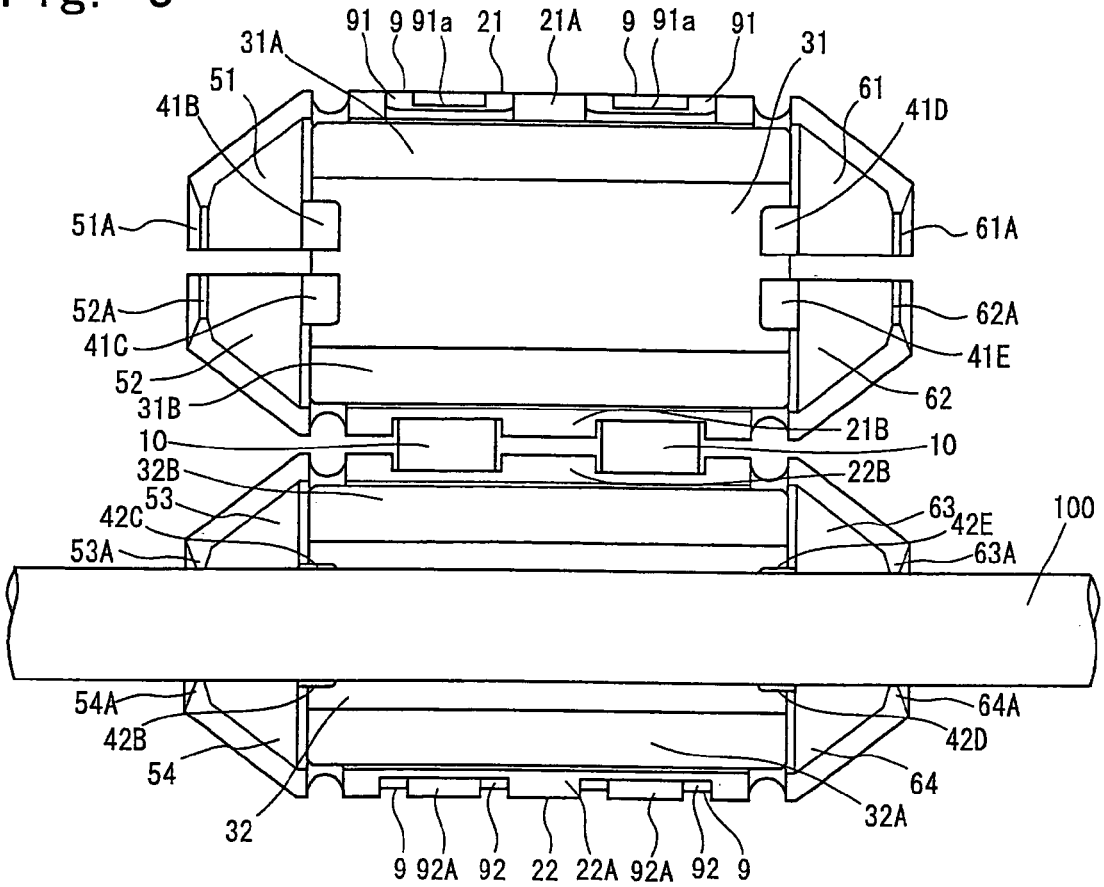
FIG. 5 is a plan view of the noise filter according the embodiment in which a casing is at its open state.

As shown in FIGS. 2 and 5, the case 2 is composed of two complementary halves, i.e., a first case 21 and a second case 22. Similarly, the core 3 is composed of two complementary halves, i.e., a first core 31 and a second core 32. As shown in FIG. 1, the case 2 includes a hollow cylindrical core-holding section 4, first and second cable-guiding sections 5 and 6, and first and second coupling sections 7 and 8. The first and second cable-guiding sections 5 and 6 are provided at the ends of the core-holding section 4, respectively. The first coupling section 7 is arranged between the first cable-guiding section 5 and core-holding section 4 for coupling the core-holding section 4 to the first cable-guiding section 5. The second coupling section 8 is arranged between the second cable-guiding section 6 and core-holding section 4 for coupling the core-holding section 4 to the second cable-guiding section 6. In the description hereinafter, the direction from the first cable-guiding section 5 toward second cable-guiding section 6 (i.e., cable-guiding direction) in FIG. 1 is defined as x-axis direction, and the direction from the first case 21 toward second case 22 and at right angles to the x-axis direction is defined as z-axis direction in FIG. 2. Further, the direction that is perpendicular to both the x-axis direction and the z-axis direction is defined as y-axis direction.

Figure 3:
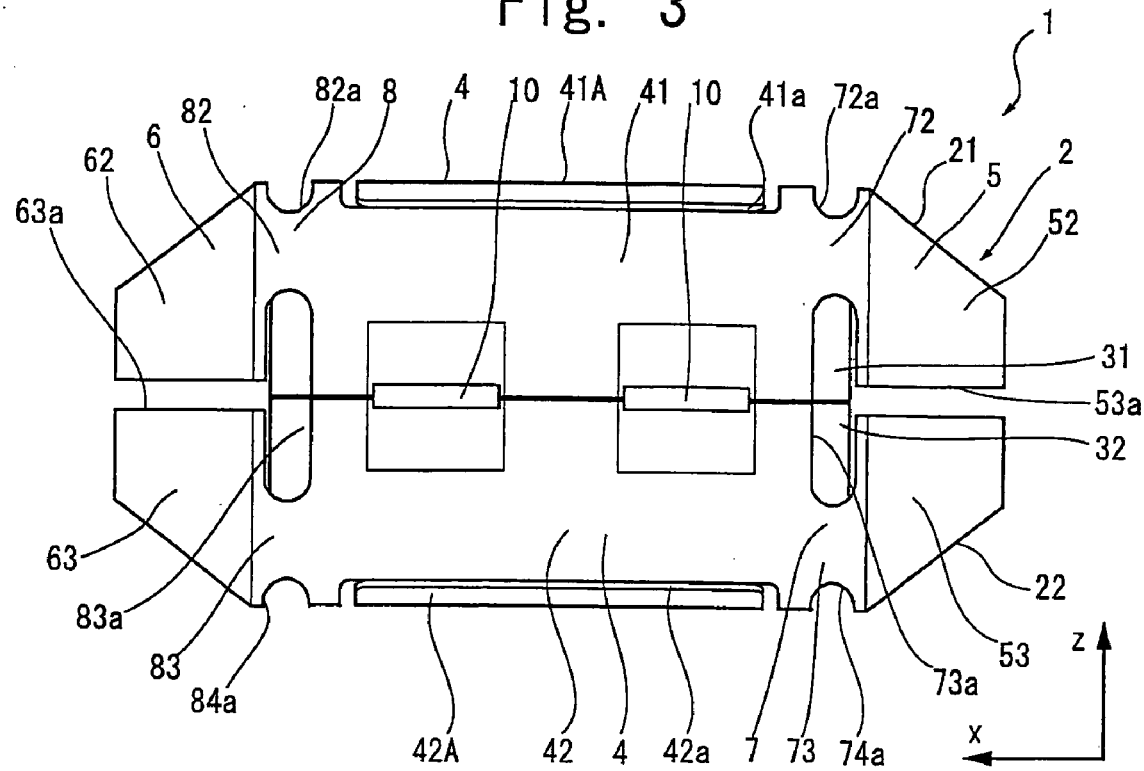
FIG. 3 is a rear view of the noise filter according the embodiment of the invention.

The core-holding section 4 includes a first core-holding part 41 and a second core-holding part 42, which are provided on the first case 21 and the second case 22, respectively. The first core-holding part 41 and the second core-holding part 42 have a semicircular cross-section, in the plane defined by the y- and z-axes. As shown in FIGS. 1 and 3, a pair of hinge sections 10, 10 which connect the first core-holding part 41 and the second core-holding part 42 together are provided at one end of the first core-holding part 41 and the second core-holding part 42 with respect to the y-axis direction (FIG. 1), and at two locations which trisect the first core-holding part 41 and the second core-holding part 42 in the x-axis direction (FIG. 3). As shown in FIG. 5, the first core-holding part 41 and the second core-holding part 42 have parting faces 21B and 22B, respectively, at positions where the hinge sections 10, 10 are provided. The first and second cases 21 and 22 are in abutment with each other on the parting faces 21B and 22B, when the first and second cases 21 and 22 are closed together.

As shown in FIG. 1, a pair of engagement sections 9, 9 are provided at each free end of each of the first and second cases 21, 22 at a position opposite to the hinge sections 10, 10 in y-axis direction for maintaining the closed state of the first and second cases 21, 22. The pair of engagement sections 9, 9 trisect the first core-holding part 41 and the second core-holding part 42 in the x-axis direction at positions corresponding to the pair of hinge sections 10,10. As shown in FIG. 5, the first and second core-holding parts 41 and 42 have parting faces 21A and 22A, respectively, at the positions where the engagement sections 9 are provided. The first and second cases 21 and 22 are in abutment with each other on these parting faces 21A and 22A.

Figure 4:
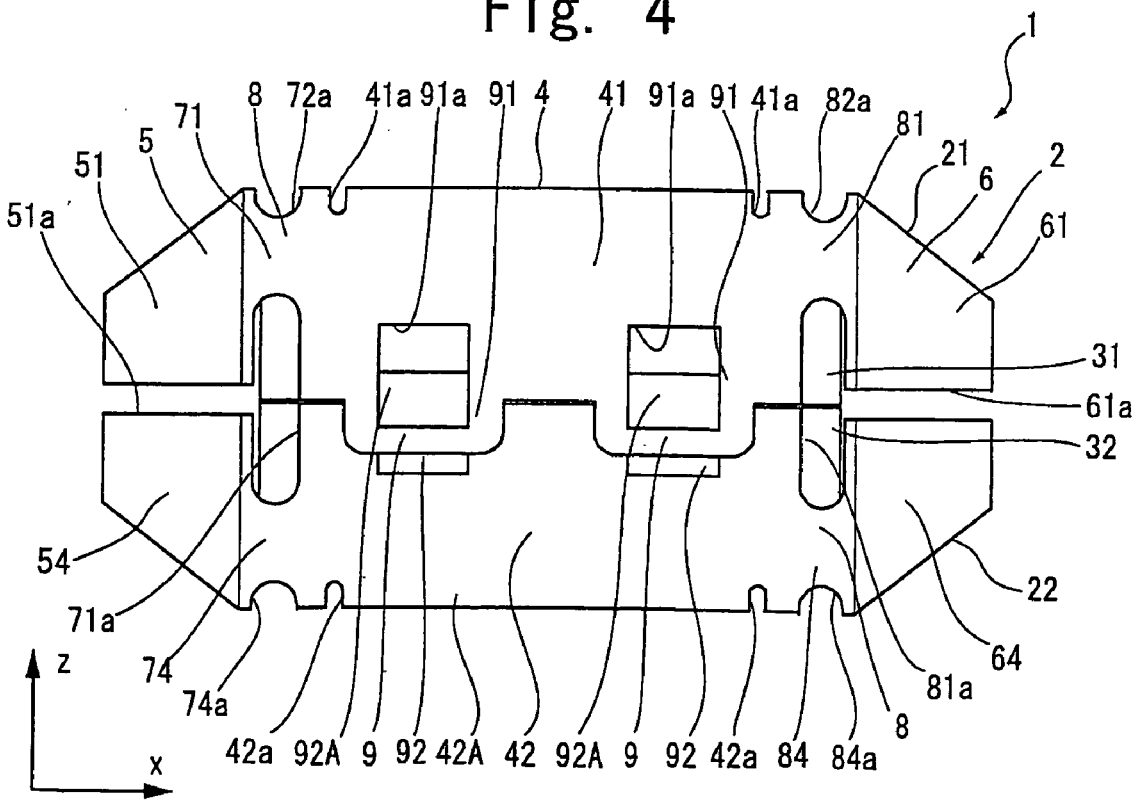
FIG. 4 is a front view of the noise filter according the embodiment of the invention.

As shown in FIG. 4, each engagement section 9 is composed of an engagement-hole forming part 91, an engagement-claw peripheral part 92, and an engagement claw 92A. The forming part 91 is provided on the first core-holding part 41 and has an engagement hole 91*a*. The peripheral part 92 is provided on the second core-holding part 42. The engagement claw 92A is provided on the engagement-claw peripheral part 92. As shown in FIG. 1, the first core-holding part 41 has a U-shaped elongated slot 41*a*. The elongated slot 41*a* includes a first part extending in the x-axis direction and located close to the hinge sections 10 and second and third parts extending from the ends of the first part in the y-axis direction toward the engagement sections 9. The elongated slot 41*a* defines a first core-pushing part 41A that is continuous to the first core-holding part 41 at the side of the engagement sections 9. The first core holding part 41 has an arcuate shape providing an imaginary center. The first core-pushing part 41A has a free end near the hinge sections 10. The free end is displaced toward the imaginary center from the arcuate contour of the first core-holding part 41 as viewed in the cross-section in a plane defined by the y- and z-axes. As shown in FIGS. 3 and 4, the second core-holding part 42 has an elongated slot 42*a* and a second core-pushing part 42A, which are the same as those of the first core-holding part 41.

Next, the first cable-guiding section 5, second cable-guiding section 6, first coupling section 7 and second coupling section 8 will be described. The first cable-guiding section 5 and first coupling section 7 are symmetrical to the second cable-guiding section 6 and second coupling section 8, with respect to the core-holding section 4. Therefore, only the first cable-guiding section 5 and first coupling section 7 will be described, though the sections 6 and 8 may be referred to in the following description.

As FIG. 1 shows, the first cable-guiding section 5 is shaped like a truncated cone with its z-x cross-sectional area gradually decreasing in the x-axis direction, from the first core-holding part 41 toward its distal end. Since the first cable-guiding section 5 is shaped like such truncated cone, a smooth and continuous included peripheral surface can be spanned between the outer peripheral surface of the cable 100 and the core-holding section 4 that is the largest diameter region of the noise filter 1. Hence, the truncated cone shape of the noise filter 1 can prevent other ambient cable or ambient stationary object from getting hung up on the noise filter 1 when the latter is disposed over the cable 100. Thus, the noise filter 1 would not be an obstacle that may hinder a layout of the cable 100.

As shown in FIG. 2, the first cable-guiding section 5 shaped like a truncated cone is divided into four parts 51, 52, 53 and 54, which are sectioned by four slits 51*a*, 52*a*, 53*a* and 54*a* and sequentially arranged in the circumferential direction of the first cable-guiding section 5. In the y-z cross-section, the first cable-guiding section 5 is divided into the four parts, 51, 52, 53, 54 by the slits 51*a*, 52*a*, 53*a* and 54*a* those arranged in a cruciform fashion whose crossing center is coincident with an imaginary apex of the truncated cone. The first cable-guiding section 5 has an opening 5*a* in its distal end. The opening 5*a* has an inner diameter smaller than the outer diameter of the cable 100 prior to setting the noise filter 1 over the cable 100. Further, parting faces of the first case 21 and the second case 22 are in alignment with and within width of the first slit 51*a* and the third slit 53*a*. Thus, the first and second parts 51 and 52 belong to the first case 21, and the third and fourth parts 53 and 54 belong to the second case 22. In other words, it is unnecessary to positively form a slit between first part 51 and the fourth part 54, and between the second part 52 and the third part 53, since the parting faces of the firs and second cases 21 and 22 can function as slits. Further, the cruciform arrangement of the slits can provide substantially equal shape among these parts 51 through 54. Therefore, these parts 51–54 can provide uniform and symmetrical pressure to the cable 100.

As shown in FIG. 2 and 5, the first to fourth parts 51 to 54 have distal ends provided with first to fourth claws 51A to 54A, respectively. The first to fourth claws 51A to 54A protrude radially inwardly in hook like fashion in the y-z plane. These claws 51A to 54A project toward a center of the opening 5*a*, and each being gradually thinning toward its radially innermost end. With this arrangement, the claws 51A to 54A can provide a stronger clamping force when a force for moving the cable 100 in its axial direction is applied relative to the case 2. The first to fourth claws 51A to 54A constitute a chuck part 5A and define the opening 5*a*.

The first coupling section 7 (FIG. 1) that couples the first cable-guiding section 5 to the core-holding section 4 has a first elongated slot 71*a* (FIG. 4), a second elongated slot 72*a* (FIG. 1), a third elongated slot 73*a* (FIG. 3) and a fourth elongated slot 74*a* (FIGS. 3 and 4). These elongated slots 71*a* to 74*a* extend in the circumferential direction of the case 2 and are located at the proximal ends of the first to fourth slits 51*a* to 54*a*, respectively. The elongated slots 71*a* to 74*a* have substantially the same shape. These elongated slots 71*a* to 74*a* are in communication, at each intermediate portion in the circumferential direction, with the first to fourth slits 51*a* to 54*a*, respectively. A first connecting part 71 (FIG. 1) lies between the first elongated slot 71*a* and the second elongated slot 72*a*. Further, a second connecting part 72 (FIG. 1), a third connecting part 73 (FIG. 3), and a fourth connecting part 74 (FIG. 4) are similarly defined. The first to fourth connecting parts 71 to 74 connect the first to fourth parts 51 through 54, respectively, to the core-holding section 4. Each of the first through fourth connecting parts 71 through 74 is positioned, respectively, at each of the intermediate positions of the first to fourth parts 51 to 54 in the circumferential direction. Hence, the first to fourth parts 51 to 54 are pivotally movable in the y-z plane so as to increase or decrease the diameter of the opening 5*a* with the first through fourth connecting parts 71 through 74 functioning as fulcrums. Further, these elongated slots 71*a* through 74*a* can increase flexibility of the cable guide section 5, which is particularly available for a cable having a relatively large diameter or a looped cable providing a cable bundled part.

Figure 6:
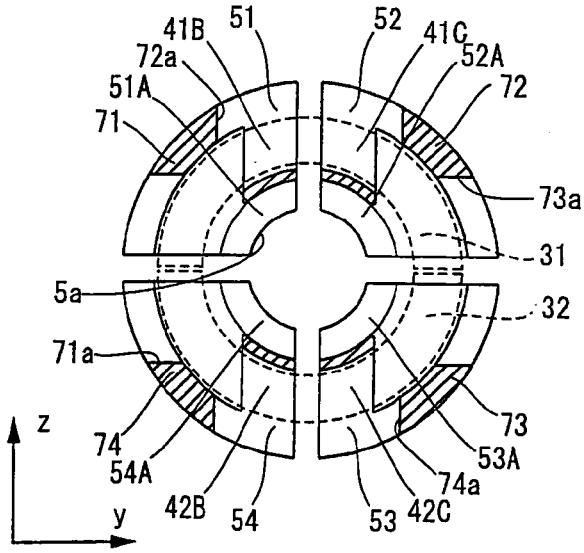
FIG. 6 is a cross-sectional view of the noise filter taken along the line VI—VI of FIG. 1.

As shown in FIG. 6, core retaining segments 41B and 41C are provided. These core retaining segments 41B, 41C are in the form of L-shape, and each having a radial part extending toward the center of the opening 5*a* (z-axis direction) and defining one side wall of the second elongated slot 72*a* and an axial part extending from a radially innermost end of the radial part toward a longitudinal center of the first core 31 (x-axis direction). Similarly, core retaining segments 42B and 42C are in the form of L-shape, and each has a radial part extending toward the center of the opening 5*a* (z-axis direction) and defining one side wall of the fourth elongated slot 74*a* and an axial part extending from a radially innermost end of the radial part toward a longitudinal center of the second core 32 (x-axis direction). Since the radial part of each of the core retaining segments serves as a wall of each of the elongated slots, a space-saving structure can be provided in the case 2.

The second cable-guiding section 6 is similar in configuration to the first cable-guiding section 5. The section 6 is divided into first to fourth parts 61, 62, 63 and 64 by a cruciform slit (when the case 2 is closed). The cruciform slit includes first slit 61*a* to fourth slit (not shown). The first to fourth parts 61, 62, 63 and 64 are connected to the core-holding section 4 by first to fourth connecting parts 81 to 84 that are defined by first to fourth elongated slots 81*a* to 84*a*. An L-shaped core retaining segment 41D extends from the first part 61, and an L-shaped core retaining segment 41E extends from the second part 62. These segments 41D and 41E define one side wall of the second elongated slot 82*a*. Similarly, an L-shaped core retaining segment 42D extends from the fourth part 64, and an L-shaped core retaining segment 42E extends from the third part 63. These segments 42D and 42E define one side wall of the fourth elongated slot 84*a*.

The first core 31 has a semicircular and arcuate cross-section in a plane perpendicular to its axis. As shown in FIG. 5, the first core 31 has a pair of first core-abutment surfaces 31A and 31B at the ends of the arc. The core-abutment surfaces 31A, 31B provide smooth planes and at a diametrical position of the resultant core 3. Similar to the first core 31, the second core 32 has a semicircular and arcuate cross-section and has a pair of second core-abutment surfaces 32A and 32B at the ends of the arc. The second core-abutment surface 32A is in contact with the first core-abutment surface 31A, and the second core-abutment surface 32B is in contact with the first core-abutment surface 31B as a result of assembly of the core 3. The core-abutment surfaces 32A, 32B provide smooth planes at a diametrical position of the resultant core 3.

The first core 31 is positioned in the semi-circular space of the first core holding part 41 as shown in FIG. 5. The core retaining segments 41B to 41E hold the inner circumferential surface of the first core 31. In this state, the first core-pushing part 41A pushes the first core 31 radially inwardly of the first core holding part 41, so that the pair of first core-abutment surfaces 31A and 31B of the first core 31 projects from an imaginary plane connecting the parting faces 21A and 21B of the first case 21. Similarly, the second core 32 is positioned in the semi-circular space of the second core holding part 42, and the core retaining segments 42B to 42E hold the inner circumferential surface of the second core 32. In this state, the second core-pushing part 42A urges the second core 32 radially inwardly of the second core holding part 42, so that the pair of second core-abutment surfaces 32A and 32B of the second core 32 projects from an imaginary plane connecting the parting faces 22A and 22B of the second case 22.

In this state, the cable 100 is held between the third claw 53A and the fourth claw 54A and between the third claw 63A and the fourth claw 64A. Thereafter, the first case 21 is pivotally moved about the hinge sections 10, 10 toward the second case 22. The first core 31 and the second core 32 are thereby closed, superposing the first core-abutment surface 31A, 31B with the second core-abutment surface 32A, 32B, respectively, as is illustrated in FIG. 1. In this case, the engagement-claw 92A of each engagement section 9 is inserted into the engagement hole 91*a* and is brought into engagement with the engagement-hole forming part 91. Further, the engagement-hole forming part 91 is in intimate contact with the engagement-claw peripheral part 92. At this time, the first core 31 and the second core 32 are urged radially inwardly by the first core-pushing part 41A and the second core-pushing part 42A, respectively, so that the resultant core 3 can provide a sealed hollow construction. Moreover, the urging force acts between the engagement claw 92A and the engagement-hole forming part 91 to move them away from each other. Therefore, the locking engagement at the engagement section 9 can be ensured. Since the core 3 can be held with the urging force, inadvertent movement of the first core 31 and second core 23 within the case 2 can be prevented.

The chuck part 5A clamps the cable 100. In this state, the first to fourth parts 51 to 54 are resiliently pivotally moved about the first to fourth connecting parts 71 to 74 functioning as fulcrums. Since the case 2 is made from a soft resin material, pivoting mobility of the first to fourth parts 51 to 54 is sufficient to easily broaden the cross-sectional area of the opening 5*a*, as long as the cable 100 is insertable into the core 3 or as long as the number of cables is small enough that all cables can be inserted into the core 3. The cable 100 can therefore be held from four directions in a desirable fashion.

Figure 7:
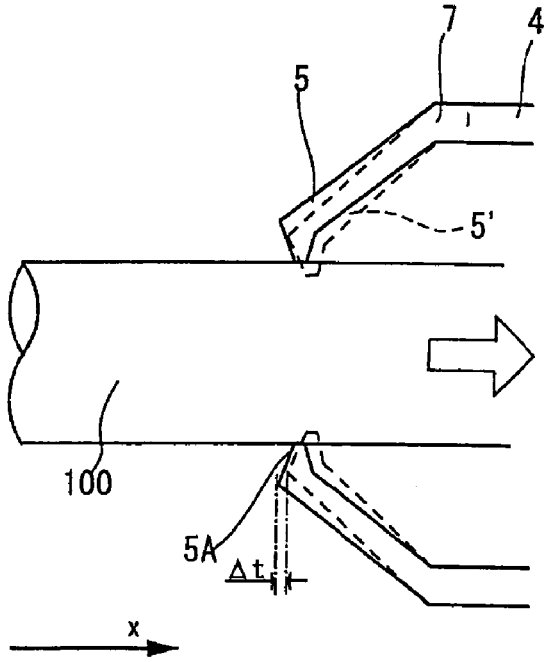
FIG. 7 is a schematic cross-sectional view of a clamp part of the noise filter according the embodiment of the invention.

The cable 100 may be pulled from the chuck part 5A by a short distance Δt, toward the core-holding section 4 in the direction (x-axis direction) as shown in FIG. 7, with respect to the noise filter 1. In this case, the first cable-guiding section 5 including the chuck part 5A moves in the x-axis direction by the distance Δt, together with the cable 100. The first cable-guiding section 5 only is pivotally moved about the first coupling section 7 acting as a fulcrum, since the core-holding section 4 provides rigidity higher than that of the first cable-guide section 5 because of the hollow cylindrical shape. Hence, when the first cable-guiding section 5 moves in the x-axis direction by the distance Δt, the first cable-guiding section 5 is pivotally moved toward inside of the core-holding section 4 as shown by a broken line 5'. As a result, the chuck part 5A further bites into the cable 100, preventing the cable 100 from displacing a distance longer than the distance Δt. Similar to the first cable-guiding section 5, the second cable-guiding section 6 can prevent the cable 100 from moving even if the cable 100 is pulled from the chuck part 6A (FIG. 1) toward the core-holding section 4 with respect to the noise filter 1.

The positions of the core retaining segments 41B to 41E and the core retaining segments 42B to 42E are coincident with the position of the elongated slots 72*a*, 82*a* of the first and second coupling sections 7 and 8. Therefore, complicated metal molds for molding the first case 21 and second case 22 are not required. Rather, the core retaining segments can be shaped after molding the semi-cylindrical parts of the first case 21 and second case 22. Further, since the chuck parts 5A and 6A are provided at axially both ends of the noise filter, the chuck parts 5A and 6A can prevent the cable 100 from moving in both rightward and leftward in FIG. 1 in its axial direction relative to the case 2.

Figure 8:
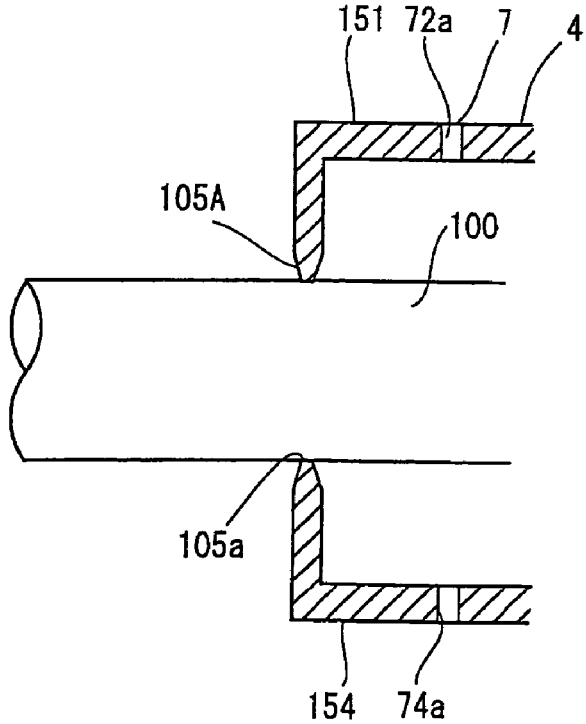
FIG. 8 is a cross-sectional view showing a cable-guiding section of a noise filter according to another embodiment of the present invention.

FIG. 8 shows a modification to first and second cable-guiding sections. In the foregoing embodiment, the first and second able guiding sections 5 and 6 have conical shape. In contrast, in the embodiment shown in FIG. 8 first cable-guiding section 151, 154 provide substantially the same outer diameter as the core-holding section 4. In this case, the first cable-guiding sections 151, 154 are resiliently pivotally movable at the coupling section 7, and the chuck part 105A moves with reducing the diameter of the opening 105*a* when the cable 100 is pulled rightward in FIG. 8 relative to the noise filter. As a result, the chuck part 105A tightens the cable 100, preventing the cable 100 from being displaced.

Thus, according to the above-described embodiments, the cable 100 can be held only by the case 2 of the noise filter 1. Therefore, the noise filter can provide a simplified structure, and a configuration of a metal mold for molding the case 2 can also be simplified. Further, since the cable 100 can be held at four sides by the resilient cable guide sections 5, 6 each divided into four parts for example, the parts 51 through 54. Accordingly, the cable 100 can be stably held by the cable guide sections even if a force applied to the cable 100 by each part 51 through 54 is small. Consequently, inadvertent crush of the cable 100 at the pressed part can be avoided to provide a prolonged service life of the cable 100. In other words, since the cable 100 can be held under a small pressure from the four parts, the cable guide section needs not be formed from a material having relatively high rigidity but can be formed from a resilient material providing sufficient flexibility. Accordingly, a cable having a relatively large outer diameter is available for the noise filter. Furthermore, since the cable is pressed at four sides, the noise filter can be disposed over a cable bundled part of a looped cable, in such a manner that four parts can desirably press the bundled part.

While the invention has been described with reference to the specific embodiment thereof, it would be apparent to those skilled in the art that various changes and modifications may be made therein without departing from the spirit and scope of the invention. For example, the inner peripheral surface of the chuck part 5A, which abuts on the cable 100, may have a zigzag form in a cross-section as viewed in the x-axis direction. In this case, the chuck part 5A assumes a plane-contact with the cable 100. This not only suppresses the deterioration of the cable surface, but also prevents the cable 100 from slipping out of the chuck part because of increase in frictional resistance by the zigzag arrangement.

Further, the first to fourth slits 51*a* to 54*a* can be shaped, such that a width of each slit is gradually decreased toward the opening 5*a*. With this arrangement, all slits will have the same width when the width of the slit at a free end expands as a result of insertion of the cable through the opening 5*a*. This sufficiently increases the contacting area of the claws 51A, 52A, 61A, 62A with the cable 100.

What is claimed is:

1. A noise filter comprising:

a case comprising a tubular core holding section having one end, a tubular coupling section disposed at at least one end of the core holding section, and a tubular cable guiding section connected to the coupling section and providing an opening through which a cable extends, the cable guiding section being tetrameric by slits including a first slit part, a second slit part, a third slit part and a fourth slit part, at least the cable guide section being made from a resilient material; and a core accommodatable in the case and providing a hollow space through which the cable extends, wherein the coupling section is formed with a plurality of elongated slits extending in a circumferential direction thereof, each of the first through fourth slit parts being in communication with a respective one of the elongated slits.

2. The noise filter as defined in claim 1, wherein the cable guiding section has a remote side opposite to the coupling section, and comprises a chuck part provided at the remote side, the chuck part defining the opening.

3. The noise filter as defined in claim 2, wherein the chuck part radially inwardly protrudes toward a center of the opening in a cross-section extending perpendicular to a extending direction of the cable, a thickness of the chuck part being gradually decreased toward a radially innermost end thereof.

4. The noise filter as defined in claim 1, wherein the cable guiding section has a diameter gradually decreased toward the remote side.

5. The noise filter as defined in claim 1, wherein the core holding section has another end, the cable guiding section and the coupling section being also provided at the another end.

6. The noise filter as defined in claim 1, wherein the case comprises:

a generally semi-cylindrical first case having a first parting face extending in an extending direction of the cable; and, a generally semi-cylindrical second case having a second parting face and contactable with the first parting face, the first slit part, the second slit part, the third slit part and the fourth slit part being arrayed in a circumferential direction of the cable guide section, the first slit part and the third slit part being defined by the first parting face and the second parting face, and the second slit part being formed in the first case, and the fourth slit part being formed in the second case.

7. The noise filter as claimed in claim 6, wherein the core comprises:

a first core having a semicircular arcuate cross-section and first ends at a diametrical position of the core, a first core parting face being provided at each first end of the first core, and a second core having a semicircular arcuate cross-section and second ends at a diametrical position of the core, a second core parting face being provided at each second end of the first core to be in contact with the first core parting face; and wherein the first case comprises a first urging region for urging the first core radially inwardly of the case; and wherein the second case comprises a second urging region for urging the second core radially inwardly, whereby the first core parting face and the second core parting face are urged toward each other when the first case and the second case are closed to each other.

8. The noise filter as defined in claim 7, wherein the first case and the second case are connected together by a hinge section, and wherein the first case and the second case further comprise engagement section for maintaining a closure of the first case with respect to the second case.

9. The noise filter as defined in claim 1, wherein the first slit part, the second slit part, the third slit part and the fourth slit part configure in combination a cruciform shape whose center is coincident with a center of the opening.

10. The noise filter as defined in claim 1, wherein the core holding section integrally provides a core retaining segment for retaining the core within a space of the core holding section, the core retaining section having a surface defining each one side of each of the first through fourth slit parts.

11. The noise filter as defined in claim 1, wherein each of the first through fourth slit parts provides a slit width in a circumferential direction of the cable guiding section, each width being gradually decreased toward the opening.

12. The noise filter as defined in claim 1, wherein the opening provides a zigzag contour in a cross-section extending in an extending direction of the cable.

13. The noise filter as defined in claim 1, wherein the tubular core holding section has a core-pushing part that pushes the core radially inwardly.

* * * * *